United States Patent [19]

Larson

[11] Patent Number: 5,020,507

[45] Date of Patent: Jun. 4, 1991

[54] COMPOUND ARCHERY BOW

[75] Inventor: Marlow W. Larson, Ogden, Utah

[73] Assignee: Browning Arms Company, Morgan, Utah

[21] Appl. No.: 198,231

[22] Filed: May 25, 1988

Related U.S. Application Data

[60] Division of Ser. No. 236,781, Feb. 23, 1981, Pat. No. 4,748,962, and a continuation-in-part of Ser. No. 12,799, Feb. 9, 1987, Pat. No. 4,774,927, which is a continuation-in-part of Ser. No. 676,740, Nov. 29, 1984, Pat. No. 4,686,955.

[51] Int. Cl.[5] ..... F41B 5/10

[52] U.S. Cl. ..... 124/25.6; 124/900

[58] Field of Search ..... 124/86, 23 R, DIG. 1, 124/25.6, 900, 23.1, 24.1, 88

[56] References Cited

U.S. PATENT DOCUMENTS

| | | | |
|---|---|---|---|
| 4,064,862 | 12/1977 | Groner | 124/DIG. 1 X |
| 4,078,538 | 3/1978 | Shepley | 124/DIG. 1 X |
| 4,261,320 | 4/1981 | Barna | 124/DIG. 1 X |
| 4,338,910 | 7/1982 | Darlington | 124/DIG. 1 X |
| 4,340,025 | 7/1982 | Caldwell | 124/86 |
| 4,368,718 | 1/1983 | Simonds et al. | 124/86 X |
| 4,686,955 | 8/1987 | Larson | 124/DIG. 1 X |
| 4,739,744 | 4/1988 | Nurney | 124/23 R |
| 4,774,927 | 10/1988 | Larson | 124/23 R |

*Primary Examiner*—Peter M. Cuomo
*Attorney, Agent, or Firm*—Trask, Britt & Rossa

[57] ABSTRACT

An eccentric for mounting at the distal end of a limb of a compound archery bow includes a step-down take-up ramp which combines the features of the side-by-side and step-down eccentrics of known eccentrics while maintaining vane clearance and avoiding development of twist on the limb. The eccentric is also provided with a cable clamp device permitting adjustment of the draw of the bow and a pivot insert which permits adjustable pivot locations for the eccentric.

4 Claims, 3 Drawing Sheets

COMPOUND ARCHERY BOW

RELATED APPLICATION

This application is a division of Ser. No. 236,781, filed Feb. 23, 1981, U.S. Pat. No. 4,748,962. It is also a continuation-in-part of commonly assigned co-pending Ser. No. 12,799, filed Feb. 9, 1987, U.S. Pat. No. 4,774,927, which is a continuation-in-part of Ser. No. 676,740, filed Nov. 29, 1984, U.S. Pat. No. 4,686,955.

BACKGROUND OF THE INVENTION

1. Field

This invention relates to compound archery bows. It is specifically directed to an improved eccentric wheel for such bows.

2. State of the Art

Compound archery bows have been well known for many years. An early patent descriptive of such bows and their mode of operation is U.S. Pat. 3,486,495. Such bows are generally characterized by "let-off" leveraging devices carried at the distal ends of the limbs. These leveraging devices are usually referred to as wheels or pulleys, although they may take various forms, including some with other than circular cross-sections. They are commonly referred to as "eccentrics," because they characteristically are pivoted around an axle located off center with respect to their perimeters.

The eccentrics carried at the tips of opposite limbs are interconnected by cables and bow string. Although various arrangements are possible, a typical arrangement includes two cables, each of which is anchored at some point on a limb and stretched accross the handle, around at least a portion of the perimeter of the eccentric carried by the opposite limb. The free ends of the cables are fastened to respective opposite ends of a string, sometimes referred to as a "central stretch". Lengths of cable are thus positioned between the string and the handle of the bow. It is important that the string be positioned with respect to the cabling (at least at fired condition), to provide adequate vane clearance. Vane clearance between the string and cables must be sufficient to avoid interference by the cables with an arrow launched by the bow. Such clearance has been provided in various ways. Sometimes, especially when narrow eccentrics are used, structures (cable guards) are carried by the handle or limbs of the bow to hold the cables out away from the plane of the string in the vicinity of the handle. In other instances, wide eccentrics are used, and the cables are located to one side of the eccentrics while the string is located at the other side of the eccentrics so that they are spaced as they cross the handle.

A common problem associated with compound bows (because of the necessity for maintaining vane clearance) is the buildup of torque in the bow limbs as the string is pulled back to full draw position. This torque results from the relatively large buildup of force in the cable system of the bow compared to that of the string. These forces are translated to the axle of the eccentric. They oppose each other in that they are translated to opposite sides of the midpoint of the axis, but they do not balance each other. As a consequence, the axis tends to rotate, thereby tending to twist the bow limb. That is, a bending movement is imparted to the limbs of the bow. A recent innovation has been to provide a spiraled groove on the eccentric so that as the string is pulled to full draw position, and the eccentric pivots, the wound cable migrates across the pulley to near the central location of the string. The force of the cable system is thus applied close to the midpoint of the axle, thereby reducing the bending moment of the limbs at full draw. When an arrow is launched and the string moves towards the handle of the bow, the eccentric pivots back to its static position, and the spiraled groove carries the cable back out to the edge of the pulley.

Eccentrics have been produced in various configurations to achieve certain special characteristics. For example, "side-by-side" pulleys have separate grooves to accommodate the "string" end of the cable and the "take-up" end of the cable. The cable passes through the interior of the pulley to gain access to both grooves. "Side-by-side" pulleys locate the string and cable forces at set distances on opposite sides of the midpoint of the axle. In this way the bending moment at full draw may be fixed within a known limit, while maintaining vane clearance. The limbs may then be strengthened on one side to compensate for the remaining bending moment imparted to the axle at full draw of the bow. This eccentric style develops relatively high speed compared to another popular type, the "step-down" pulley. "Step-down" eccentrics have a "take-up" groove of smaller diameter than the diameter of the string groove. In effect they provide a lower "gear ratio" which reduces the force developed in the cables at full draw. This reduced force effects a correspondingly reduced bending moment at the limb.

Because of the bending moments developed in the limbs at full draw, it has heretofore been necessary to provide different structural members to serve as upper and lower limbs, respectively. If an upper limb were substituted for a lower limb, the structural expedients incorporated to resist the bending moment of the upper limb would be exactly the reverse of what was required for the lower limb.

SUMMARY OF THE INVENTION

The step-down take-up ramp feature of this invention combines the desirable features of a side-by-side pulley system and a step-down pulley system. It also significantly reduces the bending moment of the bow limbs at full draw while providing for adequate vane clearance when an arrow is launched. When the bow is at static or undrawn condition, the draw string is taut and pulls on the pulley or eccentric with more force than is applied by the cable wound on the take-up side of the eccentric. In that position, the string or stretch end of the cable is positioned in a groove at one side of the eccentric and the take-up end of the cable is positioned within a groove on the opposite side of the eccentric, thereby maintaining any differential in forces within tolerable limits; that is, any resulting bending moment is of low magnitude, and does not materially affect the limb. As the eccentric pivots in response to pulling on the bow string, the wound end of the cable is cammed from its static rest position down a ramp towards the center of the eccentric, thereby carrying the force plane of the cable towards the center of the axle. As the cable travels down the ramp, the effective diameter of the eccentric decreases. Thus, the eccentric assumes the characteristics of a step-down pulley with a reduced ratio at full draw. At full draw, the forces in the cables are at their maximums, and it is a significant advantage for those forces to be applied near the centers of the axles. When an arrow is launched, the wound cable unwinds moving the wound end up the ramp, thereby increasing the ratio of the eccentric. The speed of the arrow is thus increased, as in the case of a side-by-side eccentric.

A common cable arrangement has each of the cables anchored at one end to the axle of an eccentric on the side opposite the string groove. Each cable then runs to the other eccentric, on which it is wound, ultimately connecting to one end of the string. Preferably, the string groove is located with respect to the midpoint of the axle such that its force at full draw opposes and approximately balances the force applied by the anchor end of the opposite cable. The forces referred to in this disclosure are torque forces, which when balanced, effect a diminimus bending (twisting) moment to a limb. When an arrow is nocked and the string is brought to full draw, adequate vane clearance remains between the string and the cables, and the bending moment resulting from the string, the anchored end of the opposite cable and the wound end of the proximate cable is approximately zero. Accordingly, the limbs need not be reinforced at either side, and upper and lower limbs may be made interchangeable.

The eccentrics of this invention may be configurated to function at both the upper limb and the lower limb, but it is presently preferred to use separate configurations for the two limbs. The step-down take-up ramp for the eccentric of the lower limbs is reversed in direction to that of the eccentric of the upper limb.

BRIEF DESCRIPTION OF THE DRAWINGS

In the drawings, which illustrate what is presently regarded as the best mode for carrying out the invention.

DESCRIPTION OF THE ILLUSTRATED EMBODIMENTS

Figure 1:
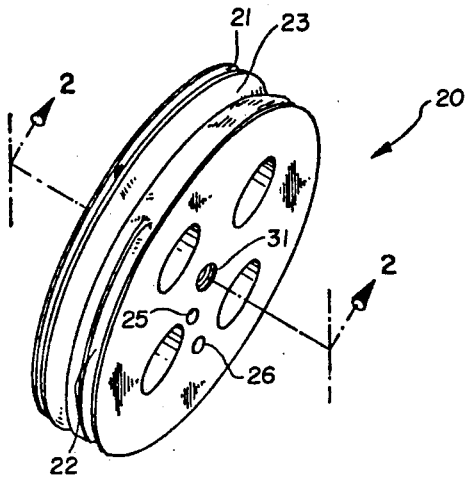
FIG. 1 is a pictorial view of one embodiment of an eccentric wheel of this invention.
Figure 2:
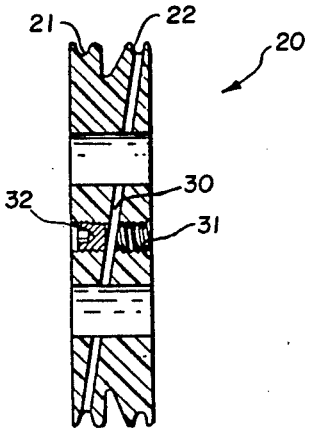
FIG. 2 is a view in cross-section taken along the line 2—2 of FIG. 1.

The eccentric wheel 20 of FIGS. 1 through 4 is relatively wide, typically approximately ¾ inch, and is of the "side-by-side" type. That is, it carries a string groove 21 at one edge and a take-up groove 22 at its opposite edge. The draw side groove 22 merges into a ramp 23 which functions to cam the cable lying in that groove either towards the center or the edge of the wheel 20 depending upon the direction of rotation of the wheel 20, as will be explained in more detail with reference to FIGS. 3 and 4. The specific eccentric 20 illustrated is for the upper limb. A corresponding eccentric for the lower limb is similar in all essential details, but the ramp 23 is configurated to wind and unwind in directions opposite those of the illustrated eccentric 20. This disclosure is directed to the upper eccentric 20 illustrated to avoid redundancy.

As illustrated, the wheel 20 includes a pair of journals 25, 26 from which the wheel 20 may selectively be mounted to a hanger structure 27 carried by the distal end of the limb 28 by means of an axle bolt 29. The grooves 21, 22 are connected by an interior bore 30 which runs diagonally through the wheel 20, as shown, usually along a diameter (in the illustrated case, the section plane). Thus, a cable (not shown) strung through the bore 30 passes through the threaded hole 31 at approximately the center of the wheel 20. The cable can thus be locked into place by turning set screw 32 until it kinks the cable into the intersection between the bores 30 and 31.

Figure 3:
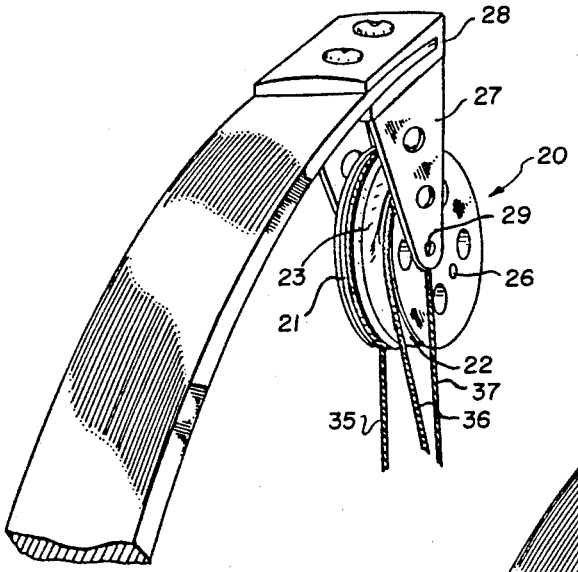
FIG. 3 is a view of a portion of a compound bow limb with the eccentric of FIG. 1 mounted to its distal end shown in static condition.
Figure 4:
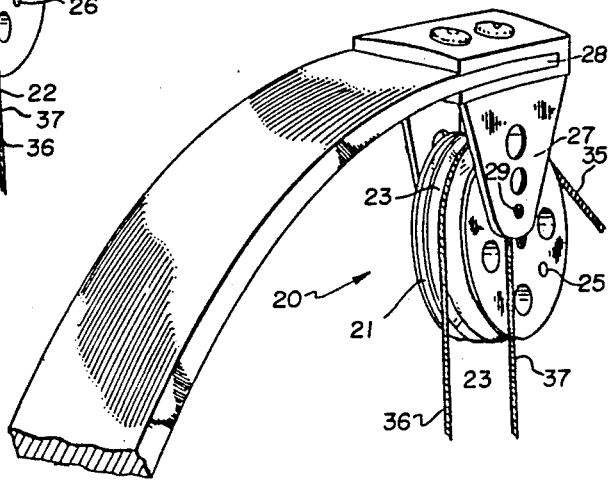
FIG. 4 is a view similar to FIG. 3 but showing the limb and eccentric in full draw condition.
Figure 5:
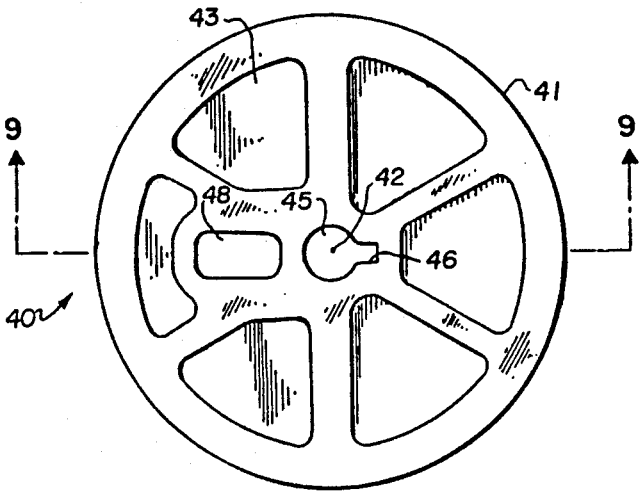
FIG. 5 is a view in elevation of one side of an alternative embodiment of the eccentric of this invention incorporating the removable pivot bearing and cable lock features of this invention.
Figure 7:
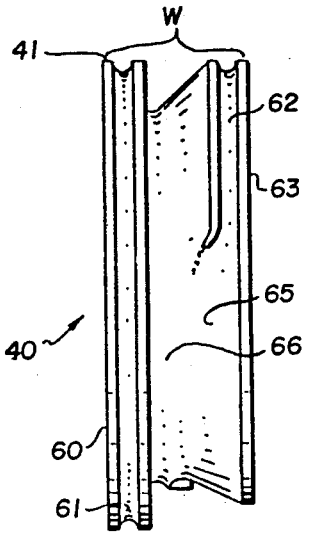
FIG. 7 is a view in elevation of the eccentric illustrated by FIG. 5 rotated 90° on an axis vertical with respect to FIG. 5.
Figure 6:
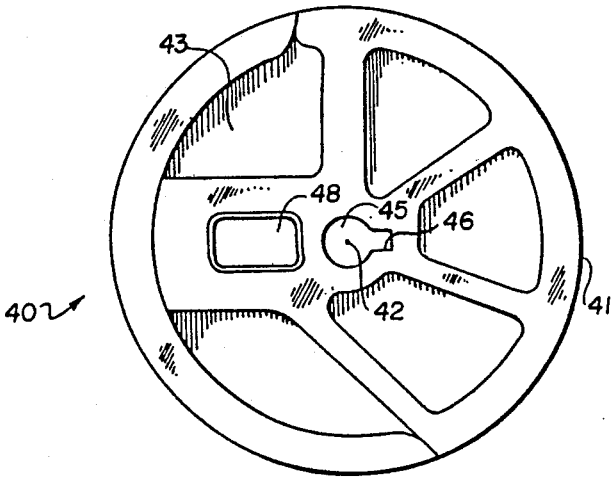
FIG. 6 is a view in elevation of the opposite side of the eccentric of FIG. 5.
Figure 8:
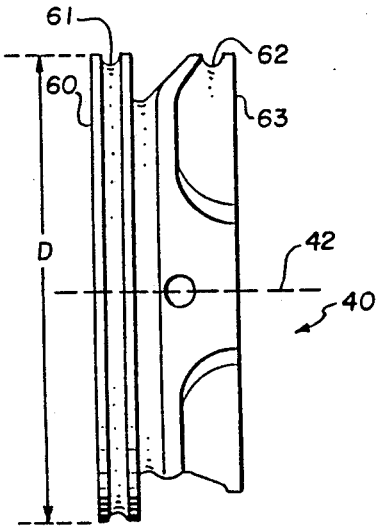
FIG. 8 is a view in elevation of the eccentric of FIG. 5 rotated 180° with respect to FIG. 7.
Figure 9:
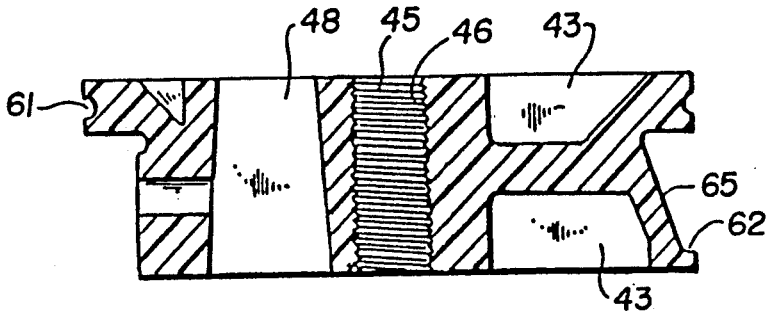
FIG. 9 is a view in cross-section taken along the line 9—9 of FIG. 5.

As best shown by FIG. 3, in the at rest (static) condition, the eccentric 20 is positioned so that the strung end 35 of the cable is contained by the groove 21 at one side of the eccentric 20 and the wound end 36 of the cable is contained by the groove 22 at the opposite side of the eccentric 20. The anchored end 37 of the other cable of the system is attached to the axle bolt 29 opposite the string groove 21. In this position, the forces applied by the two cable ends 36, 37 approximately balance the force applied by the string end 35. FIG. 4 shows the eccentric 20 pivoted at full draw so that the wound end 36 has cammed down the ramp 23. In this position, the force applied by the wound end 36 is much increased, but is applied near the midpoint of the axle 29. The torque resulting from the strung end 35 approximately balances the torque resulting from the anchored end 37. The vane clearance remains adequate, (in the illustrated instance, approximately ½ inch). The ratio developed through the eccentric in FIG. 4 is less than the corresponding ratio in FIG. 3.

A highly preferred embodiment of this invention is illustrated by FIGS. 5 through 9, which show an eccentric wheel member 40. This wheel 40 is also relatively wide W, typically ¾ inch or more, across its perimeter 41 parallel its center axis 42, and may be of any practical diameter D, typically about 2 to about 3 inches. It is preferably produced from lightweight material such as aluminum alloy or plastic, and is provided with regions 43 of reduced cross-section to limit its weight.

One edge 60 of the wheel 40 carries a groove 61 which extends around the entire perimeter 41 of the wheel 40. This groove accommodates the strung end of one of the cables of a compound bow as explained in connection with the embodiment of FIGS. 1–4. A second groove 62 is carried at the other edge 63 of the wheel 40. This groove 62 accommodates the take-up end of the same cable, and functions to hold the cable near the edge 63 of the wheel 40 when the bow is in its static condition. The ramp 65 functions as previously explained to cam the cable over and down to the valley 66 as the eccentric 40 pivots on its axle (through journal 51) to full draw condition.

As illustrated by FIGS. 5 through 9, the periphery of string groove 61 is approximately circular. The take-up groove comprised of the second groove 62, the ramp 65 and the valley 66 is characterized by a periphery which is non-concentric with the periphery of groove 61. Because of the non-circular shape of the take-up periphery, it is out of registration (it does not correspond exactly) with the periphery of the string groove 61 about substantially the entire periphery of the string groove 61. Registration of the two peripheries exists only for the portion of the take-up groove provided by the second groove 62.

It is within contemplation that the valley 66 be coplaner with the take-up groove 62 and the ramped surface 65. For example, the take-up groove may be made progressively deeper or the diameter of the eccentric carrying the take-up groove may be made continuously smaller in the direction of wind. In either event, the ratio at full draw will be relatively low, and will increase substantially when the eccentric returns to static condition. A bow may be constructed so that the torque forces on the limbs are either approximately balanced or are within tolerable limits at full draw, even though the cable is cammed only downward, and not also toward the midpoint of the axle. It is also within contemplation that the cable may be severed and segments of the cable separately attached to the eccentric to train in the string groove and take-up groove, respectively. Such segments are still considered parts of a single cable within the context of this disclosure and the appended claims.

Reference herein to details of the illustrated embodiments is not intended to limit the scope of the appended claims which themselves recite those details regarded as essential to the invention

I claim:

1. An eccentric for a compound bow comprising:

a wheel element mounted to pivot on an axis and carrying a string groove with a periphery having a geometric center remote from said axis, said string groove being parallel a plane approximately normal said axis; and a take-up groove with a periphery which is both non-concentric with and out of registration with the periphery of said string groove about substantially the entire periphery of said string groove;

said wheel element being structured for paying out from said string groove a central stretch of a bowstring whereby said central stretch is tangent to said string groove at successive first points along the periphery of said string groove as said wheel pivots on said axis from a rest position to a peak force position and then to a fully drawn position;

said wheel further being structured for receiving onto said take-up groove an end stretch of a said bowstring whereby said end stretch is tangent to said take-up groove at successive second points along the periphery of said take-up groove as said wheel pivots on said axis from said rest position to said peak force position to said fully drawn position, said second points being opposite said axis with respect to said first points;

said string groove being configured with respect to said axis such that a distance measured between the axis and any of said first points is relatively small between said rest and peak force positions, as compared to a distance measured between said axis and any of said first points between said peak force and said fully drawn positions.

2. An eccentric according to claim 1 in combination with a handle, limbs and bowstring assembled as a compound bow characterized by the force required to be applied to said bowstring to cause said wheel to pivot on its axis from its rest position increasing until said wheel pivots to its peak force position and decreasing as said wheel pivots thereafter to its fully drawn position.

3. A combination according to claim 2 wherein said takeup groove is configured such that as said bowstring is pulled to cause said wheel to pivot from its peak force position to its fully drawn position, said second points are located progressively closer to said axis.

4. A combination according to claim 3 wherein said string groove is configured such that as said bowstring is pulled to cause said wheel to pivot from its peak force position to its fully drawn position, said first points are located progressively further from said axis.

* * * * *

US005020507A

REEXAMINATION CERTIFICATE (2456th)

United States Patent [19]

[11] B1 5,020,507

Larson

[45] Certificate Issued Jan. 24, 1995

[54] COMPOUND ARCHERY BOW

[75] Inventor: Marlow W. Larson, Ogden, Utah

[73] Assignee: Browning Arms Company, Morgan, Utah

Reexamination Request:
No. 90/002,477, Oct. 15, 1991

Reexamination Certificate for:

| | |
|---|---|
| Patent No.: | 5,020,507 |
| Issued: | Jun. 4, 1991 |
| Appl. No.: | 198,231 |
| Filed: | May 25, 1988 |

Related U.S. Application Data

[60] Division of Ser. No. 236,781, Feb. 23, 1981, Pat. No. 4,748,962, Continuation-in-part of Ser. No. 12,799, Feb. 9, 1987, Pat. No. 4,774,927, which is a continuation-in-part of Ser. No. 676,740, Nov. 29, 1984, Pat. No. 4,686,955.

[51] Int. Cl.[6] ..... F41B 5/10
[52] U.S. Cl. ..... 124/25.6; 124/900
[58] Field of Search ..... 124/25.6, 900, 23.1, 124/24.1, 86, 88

[56] References Cited

U.S. PATENT DOCUMENTS

| | | | |
|---|---|---|---|
| 3,851,638 | 12/1974 | Alexander | 124/25.6 |
| 3,993,039 | 11/1976 | Groves et al. | 124/25.6 |
| 4,060,066 | 11/1977 | Kudlacek | 124/25.6 |
| 4,201,177 | 5/1980 | Holman et al. | 124/25.6 |

*Primary Examiner*—Eric K. Nicholson

[57] ABSTRACT

An eccentric for mounting at the distal end of a limb of a compound archery bow includes a step-down take-up ramp which combines the features of the side-by-side and step-down eccentrics of known eccentrics while maintaining vane clearance and avoiding development of twist on the limb. The eccentric is also provided with a cable clamp device permitting adjustment of the draw of the bow and a pivot insert which permits adjustable pivot locations for the eccentric.

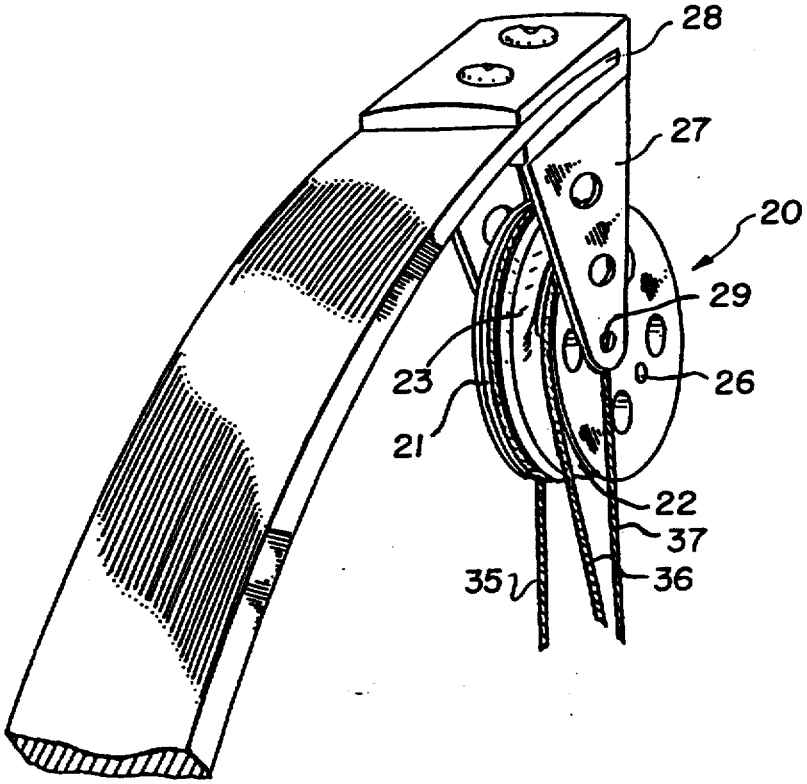

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 39–40:

*The present invention provides a number of improvements to the eccentrics for a compound bow. Ideally, the improved eccentric of this invention is embodied as a wheel of approximately circular cross-section normal its axis, incorporating an improved cable lock system, a unique pivot bearing insert, and a novel step-down take-up cable ramp. Each of these improved features is independently significant, and may be incorporated in eccentrics of various configurations which do not incorporate the other improvements of this invention. Nevertheless, each of these features contributes to the overall advantage and improved performance of a compound bow when they are incorporated together in the eccentrics of the bow in accordance with the preferred embodiments of this invention.*

Figure 10:
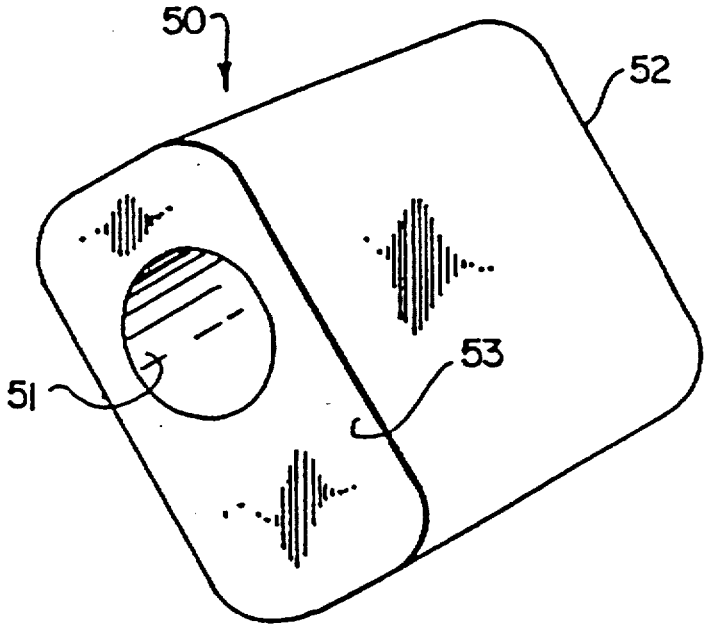

Column 3, lines 55–56:

*FIG. 10 is a pictorial view of a pivot bearing for use with the eccentric illustrated by FIGS. 5 through 9.*

Column 4, lines 48–49:

*A tapped hole 45 extends entirely through the wheel 40 at its center 42. A keyway 46 communicates with the hole 45 as shown. A second hole 48 of rectangular cross-section is provided through the wheel 40 approximately parallel its center axis 42 and radially positioned between the center 42 and perimeter 41. This hole 48 is slightly larger in cross section at one side (FIG. 6) than at its other (FIG. 5), and is thereby adapted to receive the tapered pivot bearing 50 of FIG. 10 in a press fit or interference fit relationship. The hole 48 illustrated will accommodate the pivot bearing 50 in either of two orientations, thereby offering a choice of either of two locations for the axle journal 51. The end 52 is larger than the end 53 in correspondence with the taper of the hole 48 best shown by FIG. 9.*

Column 5, lines 6–24:

It is within contemplation that the valley 66 be coplanar with the [take-up] *second* groove 62 and the ramped surface 65. For example, the take-up groove may be made progressively deeper or the diameter of the eccentric carrying the take-up groove may be made continuously smaller in the direction of wind. In either event, the ratio at full draw will be relatively low, and will increase substantially when the eccentric returns to static condition. A bow may be constructed so that the torque forces on the limbs are either approximately balanced or are within tolerable limits at full draw, even though the cable is cammed only downward, and not also toward the midpoint of the axle. It is also within contemplation that the cable may be severed and segments of the cable separately attached to the eccentric to train in the string groove and take-up groove, respectively. Such segments are still considered parts of a single cable within the context of this disclosure and the appended claims.

The drawing figures have been changed as follows: Added FIG. 10

AS A RESULT OF REEXAMINATION, IT HAS BEEN DETERMINED THAT:

Claims 1–4 are determined to be patentable as amended.

New claims 5–12 are added and determined to be patentable.

1. An eccentric for a compound bow comprising:
a wheel element mounted to pivot on an axis and carrying
a string groove with a periphery having a geometric center remote from said axis, said string groove being parallel a plane approximately normal said axis; and
a take-up groove with a periphery which is [both] *of a different shaped configuration than and* non-concentric with [and] *the periphery of said string groove, the majority of the periphery of said take-up groove being* out of registration with the periphery of said string groove [about substantially the entire periphery of said string groove];
said wheel element being structured for paying out from said string groove a central stretch of bowstring whereby said central stretch is tangent to said string groove at successive first points along the periphery of said string groove as said wheel *element* pivots on said axis from a rest position to a peak force position and then to a fully drawn position;
said wheel *element* further being structured for receiving onto said take-up groove an end stretch of [a] said bowstring whereby said end stretch is tangent to said take-up groove at successive second points along the periphery of said take-up groove as said wheel *element* pivots on said axis from said rest position to said peak force position to said fully drawn position, said second points being opposite said axis with respect to said first points;
said string groove configured with respect to said axis such that a distance measured between the axis and any of said first points is relatively small between said rest and peak force positions, as compared to a distance measured between said axis and any of said first points between said peak force and said fully drawn positions.

2. An eccentric according to claim 1 in combination with a handle, limbs and bowstring assembled as a compound bow characterized by the force required to be applied to said bowstring to cause said wheel *element* to pivot on its axis from its rest position increasing until said wheel *element* pivots to its peak force position and decreasing as said wheel *element* pivots thereafter to its fully drawn position.

3. A combination according to claim 2 wherein said [takeup] *take-up* groove is configured such that as said bowstring is pulled to cause said wheel *element* to pivot from its peak force position to its fully drawn position, said second points are located progressively closer to said axis.

4. A combination according to claim 3 wherein said string groove is configured such that said bowstring is pulled to cause said wheel *element* to pivot from its peak force position to its fully drawn position, said first points are located progressively further from said axis.

*5. An eccentric for a compound bow comprising:*

*a wheel element mounted to pivot on an axis and carrying*

*a string groove with a periphery having a geometric center remove from said axis, said string groove being parallel a plane approximately normal said axis; and*

*a take-up groove with a periphery which is non-concentric with the periphery of said string groove, the majority of the periphery of said take-up groove being out of registration with the periphery of said string groove;*

*said wheel element being structured for paying out from said string groove a central stretch of a bowstring whereby said central stretch is tangent to the string groove at successive first points along the periphery of said string groove as said wheel element pivots on said axis from a rest position to a peak force position and then to a fully drawn position;*

*said wheel element further being structured for receiving onto said take-up groove an end stretch of said bowstring whereby said end stretch is tangent to said take-up groove at successive second points along the periphery of said take-up groove as said wheel element pivots on said axis from said rest position to said peak force position to said fully drawn position, said second points being opposite said axis with respect to said first points;*

*said string groove being configured with respect to said axis such that a distance measured between the axis and any of said first points is relatively small between said rest and peak force positions, as compared to a distance measured between said axis and any of said first points between said peak force and said fully drawn positions;*

*said string groove and said take-up groove further being structured and arranged such that said second joint at which said end stretch is tangent to said take-up groove is radially closer to said periphery of said string groove when said wheel element is oriented in said rest position than said second point at which said end stretch is tangent to said take-up groove when said wheel element is oriented in said fully drawn position.*

*6. An eccentric according to claim 5 in combination with a handle, limbs and bowsting assembled as a compound bow characterized by the force required to be applied to said bowstring to cause said wheel element to pivot on its axis from its rest position increasing until said wheel element pivots to its peak force position and decreasing as said wheel element pivots thereafter to its fully drawn position.*

*7. A combination according to claim 6 wherein said take-up groove is configured such that as said bowstring is pulled to cause said wheel element to pivot from its peak force position to its fully drawn position, said second points are located progressively closer to said axis.*

*8. A combination according to claim 7 wherein said string groove is configured such that as said bowstring is pulled to cause said wheel element to pivot from its peak force position to its fully drawn position, said first points are located progressively further from said axis.*

*9. An eccentric for a compound bow comprising:*

*a wheel element mounted to pivot on an axis and carrying*

*a string groove with an approximately circular periphery having a geometric center remote from said axis, said string groove being parallel a plane approximately normal said axis; and*

*a take-up groove with a substantially non-circular periphery which is non-concentric with the periphery of said string groove, the majority of the periphery of said take-up groove being out of registration with the periphery of said string groove;*

*said wheel element being structured for paying out from said string groove a central stretch of a bowstring whereby said central stretch is tangent to the string groove at successive first points along the periphery of said string groove as said wheel element pivots on said axis from a rest position to a peak force position and then to a fully drawn position;*

*said wheel element further being structured for receiving onto said take-up groove an end stretch of said bowstring whereby said end stretch is tangent to said take-up groove at successive second points along the periphery of said take-up groove as said wheel element pivots on said axis from said rest position to said peak force position to said fully drawn position, said second points being opposite said axis with respect to said first points;*

*said string groove being configured with respect to said axis such that a distance measured between the axis and any of said first points is relatively small between said rest and peak force positions, as compared to a distance measured between said axis and any of said first points between said peak force and said fully drawn positions.*

*10. An eccentric according to claim 9 in combination with a handle, limbs and bowstring assembled as a compound bow characterized by the force required to be applied to said bowstring to cause said wheel element to pivot on its axis from its rest position increasing until said wheel element pivots to its peak force position and decreasing as said wheel element pivots thereafter to its fully drawn position.*

*11. A combination according to claim 10 wherein said take-up groove is configured such that as said bowstring is pulled to cause said wheel element to pivot from its peak force position to its fully drawn position, said second points are located progressively closer to said axis.*

*12. A combination according to claim 11 wherein said string groove is configured with respect to said axis such that as said bowstring is pulled to cause said wheel element to pivot from its peak force position to its fully drawn position, said first points are located progressively further from said axis.*

* * * * *